US005974227A

United States Patent [19]

Schave

[11] Patent Number: 5,974,227

[45] Date of Patent: Oct. 26, 1999

[54] HOT MELT MIX APPLICATOR WITH ELECTRICALLY HEATED HOSE

[75] Inventor: Floyd D. Schave, Mesa, Ariz.

[73] Assignee: Crafco, Incorporated, Chandler, Ariz.

[21] Appl. No.: 09/182,270

[22] Filed: Oct. 29, 1998

Related U.S. Application Data

[63] Continuation of application No. 08/670,332, Jun. 25, 1996, Pat. No. 5,832,178.

[51] Int. Cl.[6] ..... F24H 1/10

[52] U.S. Cl. ..... 392/478; 392/472; 392/479

[58] Field of Search ..... 392/441, 466, 392/480, 472–473; 219/420, 421, 202

[56] References Cited

U.S. PATENT DOCUMENTS 4,644,134 2/1987 Baker ..... 219/301
5,832,178 11/1998 Schave ..... 392/472

*Primary Examiner*—Teresa Walberg
*Assistant Examiner*—Thor S. Campbell
*Attorney, Agent, or Firm*—Nilles & Nilles, S.C.

[57] ABSTRACT

A method and heating system for a hose and dispenser wand of a hot melt mix applicator using a three phase heating element powered by a generator to heat the hose and wand to maintain hot melt mix material within the hose and wand in a flowable state. To selectively energize the generator to control heat input, the heating system has (1) a controller in communication with a temperature sensor carried by the hose or wand, and (2) an output in communication with a generator control input. The generator control input enables operation of the generator to be controlled by the controller for controlling heating of the hose and wand. The heating element is a cord having a first wire receiving a phase of the three phase current, a second wire receiving another phase of the current, and a third wire receiving another phase of the current, with the cord being wrapped about the hose and wand in a helical configuration. The generator preferably is a vehicle alternator modified so that it outputs three phase electrical power without requiring any voltage or current regulation. In a preferred method, the controller energizes the generator when the sensed temperature of the hot melt mix falls to or below a predetermined setpoint control temperature and deenergizes the generator when the sensed temperature rises to or above a predetermined setpoint control temperature.

34 Claims, 7 Drawing Sheets

HOT MELT MIX APPLICATOR WITH ELECTRICALLY HEATED HOSE

CROSS REFERENCE TO RELATED APPLICATION

This application is a continuation of U.S. application Ser. No. 08/670,332 filed Jun. 25, 1996, which issued on Nov. 3, 1998, as U.S. Pat. No. 5,832,178.

FIELD OF THE INVENTION

This invention relates generally to a method and hot melt Mix applicator having a heated wand and more particularly to a hot melt mix applicator having a wand heated by electrical current provided by a generator which supplies current to the heated wand on demand.

BACKGROUND OF THE INVENTION

Hot melt mix applicators are used to apply hot melt mix, in the form of an asphalt or bituminous hot melt material, on areas such as paved roads and the like for sealing, patching, or repairing the roads. These types of applicators are also used to apply hot melt material to hold in place raised or recessed pavement markers and to seal and protect inductive traffic loops.

In one such commercially successful hot melt mix applicator heretofore marketed by the assignee herein and disclosed in U.S. Pat. No. 4,692,028, the applicator has a tank for heating and storing hot melt mix that is pumped by a pump through a hose and a wand onto pavement. During periods of operation where an operator wishes not to apply mix, but desires the mix to remain hot enough to be applied on demand, the wand is inserted into a holster connected to the tank. With the wand in the holster, the pump continuously circulates mix through the hose, wand, holster and back into the tank so that it will not harden in the wand or hose and obstruct flow.

When use of the applicator is finished, the pump is briefly reversed to clear the hose and wand of hot melt mix material before the hot melt mix is allowed to cool. Unfortunately, should hot melt mix harden within either the hose or the wand, it can partially obstruct or completely block flow through the hose causing an operator to have to clean out the hose and wand before the applicator can be used to apply hot melt mix.

To improve upon this method of preventing obstruction of the hose and wand, a single phase electrical heating system has been used to prevent hot mix material from solidifying in the hose and wand. In operation, a temperature sensor on the wand or hose communicates temperature to a controller which regulates the heat input of a heating element of the system that is in contact with the hose and wand by regulating electric power applied to the element.

In the construction of the heating element, a single heating element wire and a non-heating neutral wire makeup a two-wire heating element cord that is wrapped around the hose and wand in a spiral or helical fashion. Unfortunately, a rather dangerous electric potential of at least about 110 volts A.C. is applied to the heating element during operation to heat the hose and wand. As a result, the risk of shock is great should wires become exposed or otherwise become insufficiently insulated during operation.

Additionally, because only one wire of the pair of wires of the heating element cord wrapped around the hose can generate and transmit heat, the cord must be relatively tightly coiled around the hose and wand with a minimum of space between coils to provide the proper heat flux to prevent the hot melt mix from solidifying. Unfortunately, since only one wire of the two wire heating element cord can generate heat and since both wires of the cord bear against the hose and wand, the amount of heating element wire per unit length of cord is not maximized leading to less efficient heating element operation.

Moreover, for particularly long lengths of hose, such as hoses that are about twelve feet in length or longer, more than one temperature sensor must be used in a single phase heating system to provide adequate temperature regulation so that the hose and wand will be properly heated during operation. This additional sensor disadvantageously increases the cost and potential maintenance of the heating system while it also increases the complexity and difficulty of properly heating both the wand and hose to maintain them at a temperature which will ensure good hot melt mix flow through the hose and wand.

In the control of the heating element, the temperature controller simply regulates current flow from a single phase alternator to the heating element by turning current flow on and off. In determining whether current flow should be supplied, the controller has a selectively adjustable thermostat which communicates with the temperature sensor. If the sensed temperature is too high, the thermostat will cause the controller to turn off current flow to the heating element. If the sensed temperature is too low, the thermostat will cause the controller to turn on current flow to the heating element.

To control single phase current flow, the controller is wired in series with the heating element and simply functions as an on/off switch in response to input from a temperature sensor in communication with the hose or wand. The controller does not control operation of the alternator nor the engine. It simply functions as a switch to turn on and off current flow to the heating element.

The alternator is a conventional alternator that is connected by pulleys and a belt to a drive shaft of an internal combustion engine for supplying electrical power. The alternator has an integral power regulation circuitry to convert its raw three phase lower voltage output into single phase A.C. current having a regulated voltages of at least about 110 volts. Unfortunately, this power regulation circuitry adds to the cost of the system without adding any advantage in its use or operation.

What is needed is a more efficient and economical wand and hose heating system that more safely operates at lower voltages while still providing adequate heat to maintain hot melt mix within the hose and wand at a flowable state. What is also needed is a hot melt mix applicator of relatively compact and mobile construction that has a heated hose and wand for maximizing convenience and performance of the applicator.

SUMMARY OF THE INVENTION

A method and heating system for a hose and wand of a hot melt mix applicator that uses a three phase electrical heating element powered by a selectively energizable generator to heat the hose and wand to maintain hot melt mix material within the hose and wand in a flowable state is provided. To selectively energize the generator to control heat input to the hose and wand, the heating system has (1) a temperature controller in communication with a temperature sensor carried by the hose or wand and (2) a control output in communication with an input of the generator. The control input of the generator enables operation of the generator to be controlled by the temperature controller for controlling current flow to the heating element thereby controlling heating of the hose and wand.

The hot melt mix applicator has a source of hot melt mix material that preferably is contained in a kettle. The kettle preferably is of vertically upstanding, generally cylindrical construction and preferably is of double boiler construction with an envelope between inner and outer sidewalls for receiving hot oil therein to heat hot melt mix inside of the inner wall of the kettle. To enable hot melt mix material to be pumped from the kettle when heated to a flowable state, the applicator has a pump with an inlet received in the kettle and an outlet connected to the hose.

In a preferred applicator embodiment, the kettle has a hot melt mix material pump located in between a pair of agitators within the kettle for agitating hot melt mix material within the kettle during operation. Preferably, the hot melt mix material pump is a hydraulically driven pump coupled to a hydraulic fluid pump that is connected to a drive shaft of a prime mover that preferably is an internal combustion engine.

An output shaft of the engine is also coupled to a generator of electrical power that preferably generates three phase electrical power. Preferably, the generator is a conventional vehicle alternator modified so as not to require any rectifier, voltage regulator, current regulator, or any other electrical power regulation circuitry on board the alternator for directly outputting three phase electrical power to the three phase electrical heating element.

The generator has a stator with three outputs that connect to the hose and wand heating element and a rotor that has a control input for enabling the generator to be selectively energized to control heating of the hose and wand. The control input is connected to a control output of the controller which issues a control current to turn on the rotor when the temperature of the hose or wand drops below a preset temperature.

In a preferred embodiment, the controller has its own power source that preferably is a direct current power source that preferably is a battery. To sense the temperature of the hose or wand, the controller has a pair of inputs connected by wires to the temperature sensor which is affixed to the hose or wand. Preferably the temperature sensor is an RTD thermocouple for sensing the temperature of the hose or wand. Preferably, the temperature sensor is affixed to the hose adjacent the kettle end of the hose. Preferably, the sensor is affixed to the hose about six inches from the kettle end of the hose.

To prevent hot melt mix material from solidifying within both the hose and wand, the three phase heating element is in communication with both the hose and wand. The heating element is comprised of three heating element wires, each wire for carrying a phase of the three phase electrical current from the generator. The wires of the heating element are received in insulating material which spaces each of the wires apart from each other forming a cord. The heating element cord is wrapped in a spiral or helical configuration around a wall of both the hose and the wand. At one end of the heating element cord, each of the wires of the heating element cord are connected to an output terminal of the generator. At the other end of the heating element cord, the ends of each wire are connected to each other.

Preferably, each spiral or coil of the heating element cord is spaced about three quarters of an inch from adjacent spirals or coils for producing a heating flux of at least about 2.5 watts per inch$^2$ and preferably produces an optimum heating flux of about 3.5 watts per inch$^2$ when a preferred combination of three phase voltage and current are passed through each heating element wire. Alternatively, adjacent coils of the cord can be spaced apart between about one half inch to about one inch while still producing sufficient heat flux density to achieve proper heating of the hose and wand.

Preferably, the cord is wrapped relatively tightly around the hose and wand so that it bears against the hose and wand to maximize heat transfer from each of the heating element wires to the hot melt mix material within the hose and wand. Preferably, the cord is affixed directly to the hose and wand such as by tape that can be an insulating tape like silicone tape.

The heating element cord of the hose is connected in series with the heating element cord of the wand. To accommodate the hose being connected to the wand, the heating element cord of the hose has a non-heating portion which is connected by an electrical connector to a non-heating portion of the heating element cord of the wand, thereby connecting both cords in series. The connector allows the hose or the wand to be quickly exchanged with another hose or wand, should such a need arise. Preferably, the cord also has a non-heating portion connected by such a connector to a power cord of the applicator adjacent the kettle.

The heating element wire is constructed of a resistance-type heating wire, such as a copper wire, a copper alloy wire, nichrome, an iron-nichrome-aluminum alloy, or another type of wire capable of relatively efficiently generating heat upon the passage of current through the wire. Each of the non-heating portions of the cord is preferably constructed of copper wire having a thickness of preferably at least about fourteen gauge.

In a preferred hose construction, the hose is comprised of an inner wall formed of a strong and resilient material, such as preferably braided stainless steel hose, forming a conduit through which hot melt mix material passes during operation. The inner wall has a layer of silicone that preferably is silicone tape. Overlying this layer of silicone is the three phase heating element cord, which is wrapped in a helical spiral around the silicone layer and inner hose wall. Wrapped around the cord is another layer of silicone that preferably is silicone tape. On its exterior, the hose has a tough, durable, flexible and resilient outer rubber covering that overlies a layer of insulation that preferably can be an open or closed cell insulating foam. The temperature sensor is preferably received in a hollow in the insulation and is urged against the inner hose wall by tape wrapped around the hose. At each end of the hose is a threaded fixture for enabling the hose to be fluidtightly connected at one end to the kettle and at its other end to the wand.

The wand has a gun-type dispenser adjacent its connection with the hose. Extending outwardly from the dispenser gun is a generally rigid and generally cylindrical hollow barrel that forms a hot melt mix flow tube through which the hot melt mix material flows during operation. The heating element cord is wrapped in a spiral or helical configuration preferably around the radially outer surface of the hot melt mix flow tube to maximize heat transfer from the cord, through the tube and to the hot melt mix in the wand. Preferably, the cord is secured against the tube by tape wrapped around the cord and tube or by another means.

To prevent a user from being burned during operation, the wand has a larger diameter outer support tube generally coaxially telescoped over the hot melt mix flow tube. To prevent heat loss and to prevent a user from being burned, insulation can be received in an envelope between the radially outer surface of the hot melt mix flow tube and the radially inner surface of the support tube. To space the tubes apart from each other, there preferably is a spacer cap on the end of the hot melt mix flow tube. To prevent the wand from dripping during operation, the nozzle at the free end of the wand preferably has a duckbill type valve.

The temperature controller has a programmable thermostat-type circuit which is in control with an external control temperature input that is selectable by the user of the hot melt mix applicator. Preferably, the external control temperature input is a knob attached to a shaft of a variable control mechanism, such as a variable resistor, variable capacitor, potentiometer, or another suitable variable control mechanism that can be analog or digital.

During operation, the temperature of the hot mix material in the hose is sensed by the controller and compared with the control temperature to determine whether to energize the generator to supply current to the heating element to heat the hose and wand. If the sensed hot melt mix temperature is above a suitable threshold above the control temperature, the controller will not energize the generator and no heat will be applied to the hose and wand. If, however, the hot melt mix temperature is less than the control temperature or below a threshold less than the control temperature, the controller energizes the generator thereby causing the heating element to heat the hose and wand. To energize the generator, the controller sends a control current from its output to the rotor input of the generator.

In a preferred embodiment of the hose and wand heating system, the controller has a lower setpoint control temperature indexed to the control temperature preset by the user that can be, for example, five degrees, ten degrees, fifteen degrees or another predetermined increment below the control temperature set. Alternatively, the lower setpoint control temperature can be the same as the control temperature set by the user. To determine when to deenergize the generator, the controller has an upper setpoint control temperature that is indexed to the control temperature and which can be a predetermined value of, for example, five degrees, ten degrees, fifteen degrees or another amount greater than the control temperature.

In another preferred controller embodiment, the controller can be constructed and arranged to control engine operation to selectively regulate the power output of the generator to control heating of the hose and wand by the heating element. The controller has an output in communication with an engine controller that preferably can controllably vary the speed of the engine to control generator power output. Preferably, the engine controller is a solenoid coupled to the engine throttle.

In one preferred engine control regimen, the controller senses the voltage, current or power being supplied by the generator to the heating element and adjusts engine speed accordingly. In another preferred control regimen, the controller adjusts engine speed in according to the temperature of the hot melt mix material within the hose or wand.

In a still further control regimen, the controller energizes the generator based upon the hot melt mix temperature sensed by the temperature sensor and controls engine speed while the generator is energized. The generator is preferably selectively energized based upon the sensed temperature and/or the electrical load of the heating element.

Objects, features and advantages of this invention are to provide a hot melt mix applicator hose and wand heating system and method for controlling heat applied to a hose and wand of a hot melt mix applicator which: more efficiently heats the hose and wand using three phase electrical power; simplifies, lessens cost and increases reliability by utilizing a three phase generator that is an off-the-shelf vehicle alternator advantageously not requiring a rectifier or regulator; maximizes heat transfer and achieves more uniform heat flux by utilizing a three phase heating element that does not require a non-heating neutral or return wire; minimizes engine load and better controls heating of the hose and wand by selectively energizing the generator only when electrical power is needed; operates more safely at a lower voltage; and is a hose and wand heating system that has a minimum of components, is rugged, simple, flexible, reliable, and durable, and which is of economical manufacture and which is easy to assemble and simple to use.

BRIEF DESCRIPTION OF THE DRAWINGS

These and other objects, features, and advantages of this invention will become apparent from the following detailed description of the best mode, appended claims, and accompanying drawings in which:

DETAILED DESCRIPTION OF THE INVENTION

I. Introduction

Figure 1:
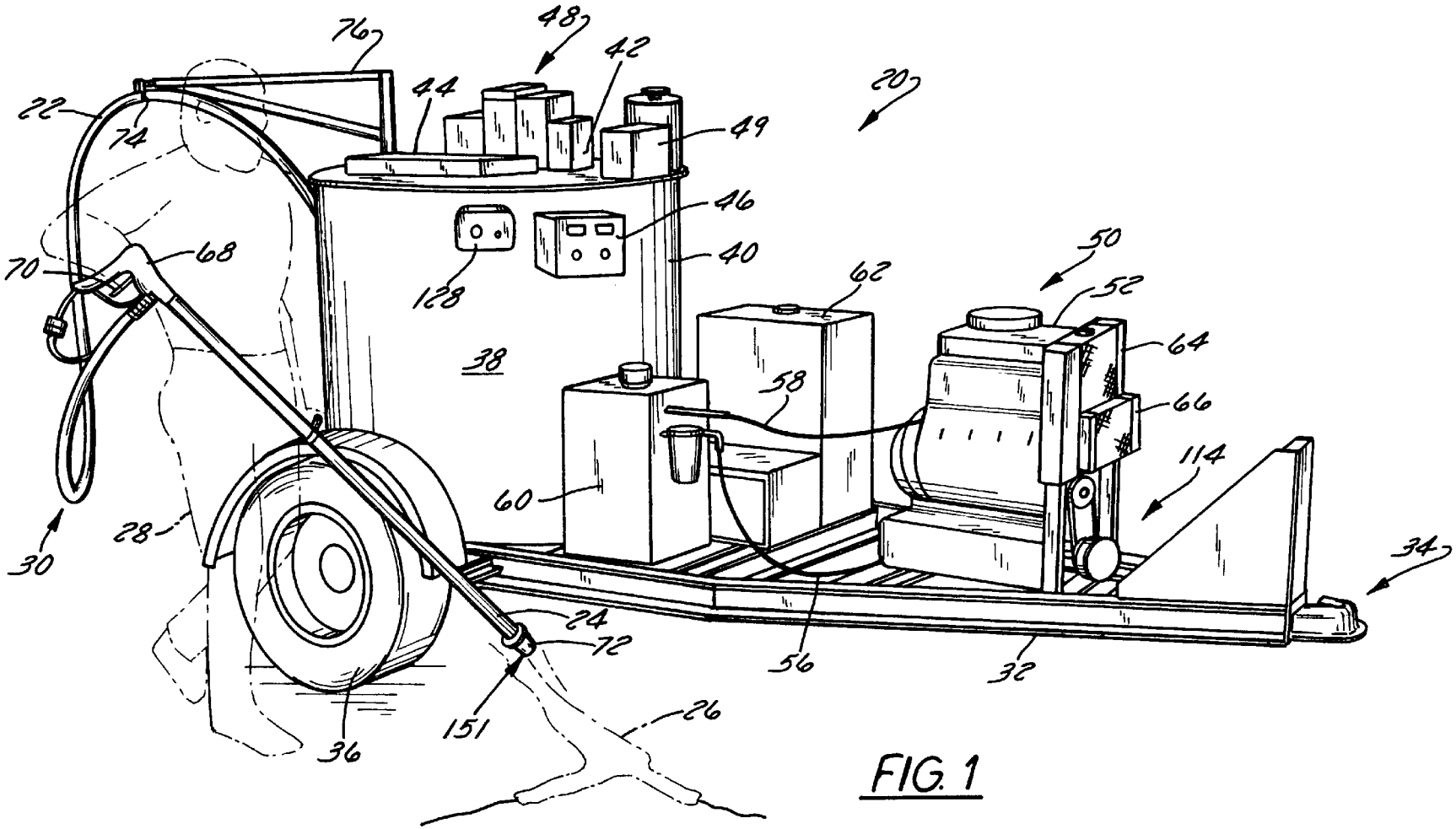
FIG. 1 is a perspective view of a hot melt mix applicator having a hose and wand heating control system of this invention.

FIG. 1 illustrates a hot melt mix applicator 20 that utilizes a heated hose 22 and a heated wand 24 of this invention for controllably dispensing a heated flowable material 26 (in phantom) that preferably is a hot melt material or mixture such as bitumen, tar, an asphalt mixture, a resin, a thermoplastic, or another material capable of being made flowable upon heating to a desired temperature. To more efficiently heat the hose 22 and wand 24 while minimizing the risk and severity of shock to a user 28 (in phantom) of the applicator 20, three phase current of a relatively low voltage is applied to a heating element 30 (FIGS. 4 and 5) in contact with both the hose 22 and wand 24.

II. Hot Melt Mix Applicator

Figure 3:
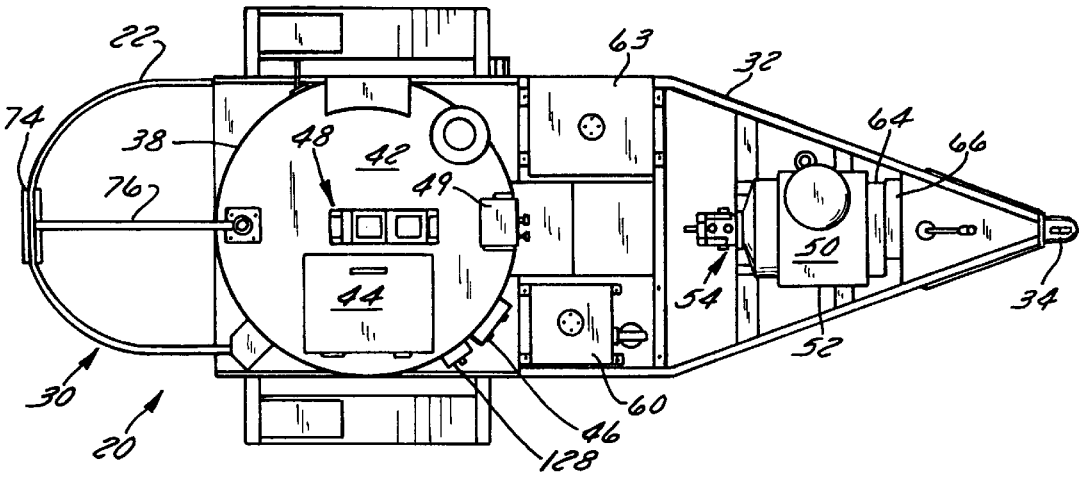
FIG. 3 is a top view of the applicator.
Figure 2:
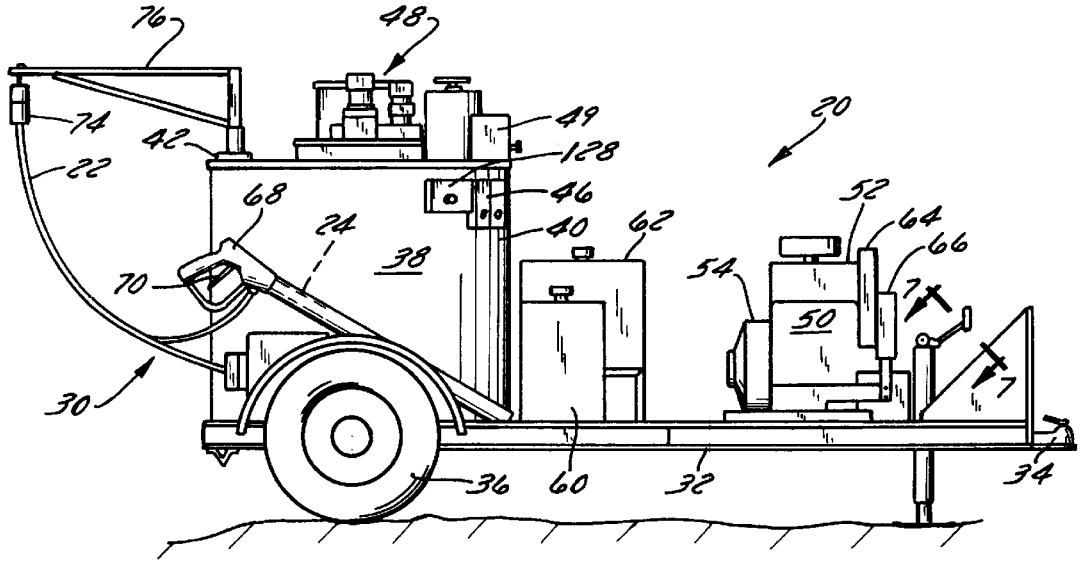
FIG. 2 is a side view of the applicator.

As is shown in FIGS. 1–3, the hot melt mix applicator 20 has a support frame 32 with a vehicle hitch assembly 34 at one end and which is supported on a pair of wheels 36 adjacent its other end. Carried by the frame 32 is a source of heated flowable material that preferably is a mixture of hot melt material received in an insulated and heated kettle 38.

The kettle 38 has a bottom wall, a generally cylindrical side wall 40, a top wall 42 and preferably is vertically upstanding in the manner shown in FIGS. 1–3. Hingedly attached to the top wall 42 is a hatch cover 44 that can be opened to put one or more solid bricks (not shown) of hot melt mix inside the kettle 38. Preferably, the kettle 38 is of double boiler construction having an interior wall spaced apart from the exterior side wall creating an envelope therebetween in which hot oil circulates during operation to heat the hot melt mix within the kettle 38 to or above a temperature at which it becomes flowable. Preferably, the kettle can be constructed and arranged substantially in accordance with the generally cylindrical sealant melting tank disclosed in U.S. Pat. No. 4,159,877, the disclosure of which is hereby expressly incorporated herein.

To heat the oil and the hot melt mix material, one or more heating coils are preferably immersed in the oil. To directly heat the hot melt mix material, one or more heating coils can be located inside the interior wall of the kettle 38 in direct contact with hot melt mix inside the kettle 38. Alternatively, a gas burner (not shown) in the underside of the kettle 38 and which is coupled to a supply of gaseous fuel can be used to heat the oil to, in turn, heat the hot melt mix material.

To selectively control the temperature of the heated oil to ultimately regulate the temperature of the hot melt mix material within the kettle 38, the applicator 20 has a temperature controller 46 in communication with (1) a temperature sensor immersed in the oil to sense directly the temperature of the oil and (2) a temperature sensor in contact with hot melt mix within the kettle 38. As is shown in FIG. 1, the hot melt mix temperature controller 46 preferably is constructed and arranged such that it has a display for displaying the temperature of the oil, a knob below the display for selecting the desired hot oil temperature, another display for displaying the temperature of the hot melt mix material inside the kettle 38, and a knob below it for selecting the desired hot melt mix temperature.

During initial operation, hot melt mix material within the kettle 38 is heated to a temperature of between about 350° F. and about 400° F. so that it will be in a flowable or even a liquified state. However, depending upon the type and nature of the material within the kettle 38 that is to be heated and applied, the hot melt mix material temperature can be greater or lower than the aforementioned range.

When the hot melt mix is heated to a temperature at or above which it becomes flowable, can be pumped, or even is liquified, the hot melt mix inside the kettle 38 preferably is agitated by an agitator and pump assembly 48. Preferably, the agitator and pump assembly 48 has at least one agitator inside the kettle 38 to stir the hot melt mix to help keep it at a more uniform temperature throughout the kettle 38. Additionally, each agitator also helps to keep solids, such as fibers, granules or other particles, suspended in the mixture while it is in a heated and flowable state.

The agitator and pump assembly 48 also includes a pump (not shown) having an inlet in communication with hot melt mix inside the kettle 38 and an outlet in communication with the hose 22 for pumping heated hot melt mix material from within the kettle 38 to the hose 22 and wand 24 for being dispensed from the wand 24. The hot melt mix pump preferably is a hydraulically operated pump that preferably is of gerotor or gear-rotor construction for delivering hot melt mix material from within the kettle 38 to the hose 22 and wand 24. To control operation of the agitators and hot melt mix pump, there preferably is a control panel 49 carried by the kettle 38.

In one preferred embodiment of the hot melt mix applicator 20, the hot melt mix pump is positioned inside the kettle 38 between a pair of spaced apart agitators in the kettle 38 for enabling solids, such as fibers and the like, to remain suspended in heated hot melt mix material within the kettle 38. Preferably, the agitator and hot melt mix pump assembly 48 is constructed and arranged substantially in accordance with a pump and agitator assembly embodiment disclosed in U.S. Pat. No. 4,859,073, the disclosure of which is hereby expressly incorporated herein.

To provide power to operate the hot melt mix pump, the applicator 20 has a prime mover 50 that preferably is an internal combustion engine 52, such as a diesel engine. Alternatively, the prime mover 50 can be a gasoline engine, an electric motor, a hydraulic drive, a pneumatic drive, or another type of power source. As is shown in FIG. 1, operably connected to the engine 52 is a hydraulic fluid pump 54 having an inlet line 56 and a return line 58 in communication with a hydraulic fluid tank 60. To provide fuel for operating the engine 52, the applicator 20 has a fuel tank 62 carried by its support frame 32.

During operation, the engine 52 powers the hydraulic fluid pump 54 which supplies hydraulic fluid under pressure to the hot melt mix pump to cause flowable hot melt mix material to be pumped from the kettle 38 to the hose 22 and wand 24. To cool the engine 52 during operation, the engine 52 has a radiator 64. To cool hydraulic fluid during pump operation, the engine 52 preferably also carries a hydraulic fluid radiator 66.

To control the application of hot melt mix pumped from the kettle 38 to the wand 24 and dispensed from the wand 24, the wand 24 has a gun-type dispenser 68 at one end. To selectively dispense hot melt mix from the wand 24, the dispenser gun 68 has a trigger 70.

In a preferred embodiment of the hot melt mix applicator 20, the trigger 70 communicates directly with the hot melt mix pump to control pump operation for relatively precisely regulating the flow of hot melt mix material from the wand 24. Preferably, when the trigger 70 is depressed, it turns on the hot melt mix pump causing hot melt mix material to be dispensed from the wand 24. When released, the trigger 70 turns the pump off stopping flow to the wand 24 thereby regulating hot melt mix flow through the wand 24 and hose 22. Preferably, the control apparatus for enabling selective dispensing of hot melt mix material in this manner can be constructed and arranged substantially in accordance with the melt mix flow control apparatus disclosed in U.S. Pat. No. 4,692,028, the disclosure of which is hereby expressly incorporated herein.

To minimize and preferably substantially prevent hot melt mix from dripping from the end of the wand 24, the end of the wand 24 preferably has a resilient and flexible duckbill-type valve 72 (FIGS. 1 and 5), that can be of disposable construction. In an alternative embodiment, during operation, the hot melt mix pump can continuously operate to supply hot melt mix under pressure to a wand 24 having a dispenser with a conventional valve that can be selectively opened to dispense hot melt mix material from the wand 24 and closed to stop dispensing hot melt mix material.

III. Hose and Wand Construction

A. Hose Construction

As is shown in FIGS. 1–3, the hose 22 is received in a cradle 74 carried by a pivoting swing arm 76 that is attached to the kettle 38 to enable a user 28 of the hot melt mix applicator 20 to more quickly and easily maneuver the hose 22 and wand 24 during operation. The hose 22 is of flexible and resilient construction and is connected to a fitting extending outwardly from the kettle 38 at one end and to the dispenser gun 68 of the wand 24 at its other end.

Figure 4:
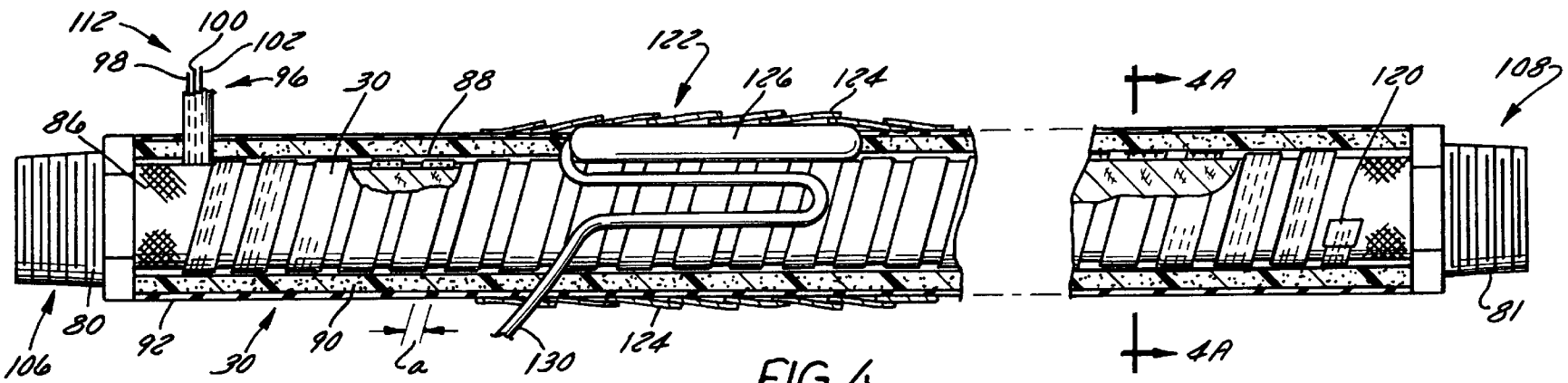
FIG. 4 is a partial fragmentary side view of a hose of the applicator broken away to show its three phase heating element and temperature sensor.
Figure 4B:
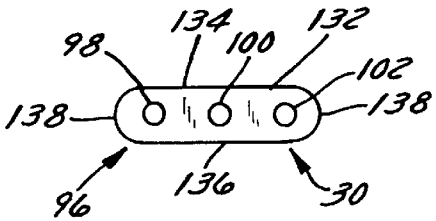
FIG. 4B is a cross sectional view of the three phase heating element cord taken along line 4B—4B of FIG. 4.
Figure 4A:
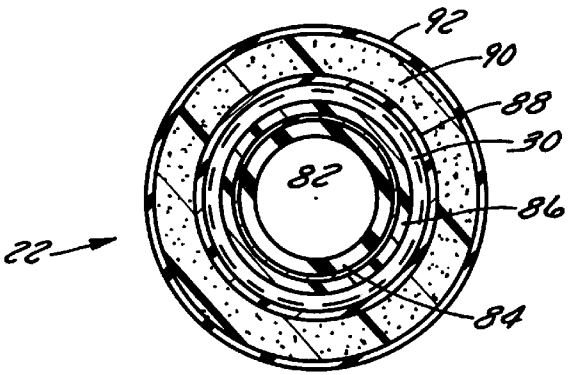
FIG. 4A is a cross sectional view of the hose taken along line 4A—4A of FIG. 4.

As is shown in FIGS. 4 and 4A, the hose 22 is elongate, generally cylindrical and flexible for enabling the wand 24 to be easily moved and positioned to allow a user 28 to precisely dispense hot melt mix material 26 in a desired location on the ground or pavement. At one end 104 of the hose 22 shown in FIG. 4, the hose 22 has a threaded fitting 80 for being sealingly mated to a complementary threaded fitting (not shown) of the kettle 38. At its other end 106, the hose 22 has another threaded fitting 81 for being sealingly mated to a complementary threaded fitting 110 (FIG. 5) of the wand 24.

The hose 22 has a hollow conduit 82 defined by an inner wall 84 of generally circular cross section that is preferably constructed of braided stainless steel and through which hot melt mix material can flow after it has been heated to or above its flow temperature. Wrapped around the exterior of the interior hose wall 84 is a layer of silicone 86 that preferably is formed of a silicone tape. To maximize heat transfer from the heating element 30 to the hot melt mix material within the hose conduit 82, the heating element 30 is wrapped in a spiral or generally helical arrangement around both the silicone wrapping 86 and the inner wall 84 of the hose 22. To help electrically and otherwise insulate the heating element 30, there is another wrapping 88 of an insulating material that preferably also is silicone tape. To both thermally and electrically insulate the inner hose wall 84 and heating element 30, the second silicone wrapping 88 is preferably covered by a thicker layer of an insulating material 90 that preferably is, for example, an open or closed cell foam insulation. To provide a resilient and durable exterior, the layer of foam insulation 90 is covered by an outer layer of a flexible, resilient and durable material 92 that preferably is a rubber that is also capable of providing both electrical and thermal insulating properties. Advantageously, the construction and arrangement of the various layers which make up the hose 22 enable the hose 22 to transport hot melt mix material having a temperature of in excess of 300° F. without a user 28 being burned or receiving an electric shock.

To prevent hot melt mix inside the hose 22 from solidifying in the hose 22 during operation, coaxially wrapped in a spiral or helical arrangement around the inner wall 84 of the hose 22 is the heating element 30. The heating element 30 is comprised of a cord 94 having three wires 96, each of which carries current during operation to generate heat to heat the hot melt mix material within the hose conduit 82.

The three wire heating element 30 is a three phase heating element for carrying three phase current to more efficiently heat the hot melt mix within the hose 22. As is shown in FIGS. 4 and 4B, the heating element cord 94 has a first wire 98 for carrying one phase of the three phase heating current, a second wire 100 for carrying another phase of the three phase heating current, and a third wire 102 for carrying a further phase of the three phase heating current.

As is shown in FIG. 4B, to prevent electricity from passing between the wires 98, 100 and 102 during operation, the exterior cord material is constructed of an electrically insulating material 132 that preferably also spaces each wire apart from the other wires to further prevent short circuiting. The cord 94 preferably is of generally elongate and oblong cross section having a top surface 134, a bottom surface 136 and a pair of sides 138 constructed and arranged such that its width is at least slightly larger than its thickness. To maximize heat transfer from the wires 98, 100 and 102 to the hose 22 and hot melt mix material flowing through the hose 22, the cord 94 is wrapped around the hose 22 such that one of its elongate surfaces, 134 or 136, are in contact with the hose 22. Preferably, the cord 94 is wrapped around the hose 22 such that its generally flat bottom surface 136 is in contact with the silicone layer 86 overlying the inner hose wall 84 and bears against the inner hose wall 84. In this manner, heat generated by all three wires 98, 100 and 102 is efficiently transmitted through the silicone 86, inner hose wall 84 and to the hot melt mix material flowing through the hose 22 to help keep the material in a flowable state.

To provide the desired heat flux along the length of the hose 22 to prevent solidification, the distance, a, between adjacent loops or coils of the cord 94 is about three quarters of an inch. Alternatively, the cord 94 can be wrapped about the hose 22 such that the distance between adjacent loops or coils, a, is between about one-half inch and about one inch. In a preferred embodiment, the heating element cord 94, the wires 98, 100 and 102, the spacing, a, between adjacent loops of the cord 94, and the three phase current applied to the cord 94 are selected to provide a heat flux of about 3.5 watts per $inch^2$.

Each wire 98, 100 and 102 of the cord 94 is constructed of an electrically conductive material that has sufficient resistance to electrical current flow such that it generates heat upon the passage of current through the heating element wire. Preferably, each wire 98, 100 and 102 is constructed of a resistive copper material, nichrome, an iron-nichrome-aluminum alloy, or another electrically resistive, electrically conductive material that produces heat upon the application of electrical current. Preferably, each wire 98, 100 and 102 is constructed of teflon coated copper and can have a wire diameter of about eighteen gauge.

Advantageously, the construction and arrangement of the heating element 30 is such that each wire 98, 100 and 102 of the heating element cord 94 wrapped around the hose 22 generates heat when three phase current is applied to the heating element 30. Advantageously, no neutral or return wire is required, so all of the wires 98, 100 and 100 of the heating element 30 generate heat to more efficiently heat the hot melt mix material inside the hose 22 and wand 24. As a result, the surface area of heat generation is maximized per unit length of heating element cord 94 as compared to a single phase heating element cord.

Figure 5:
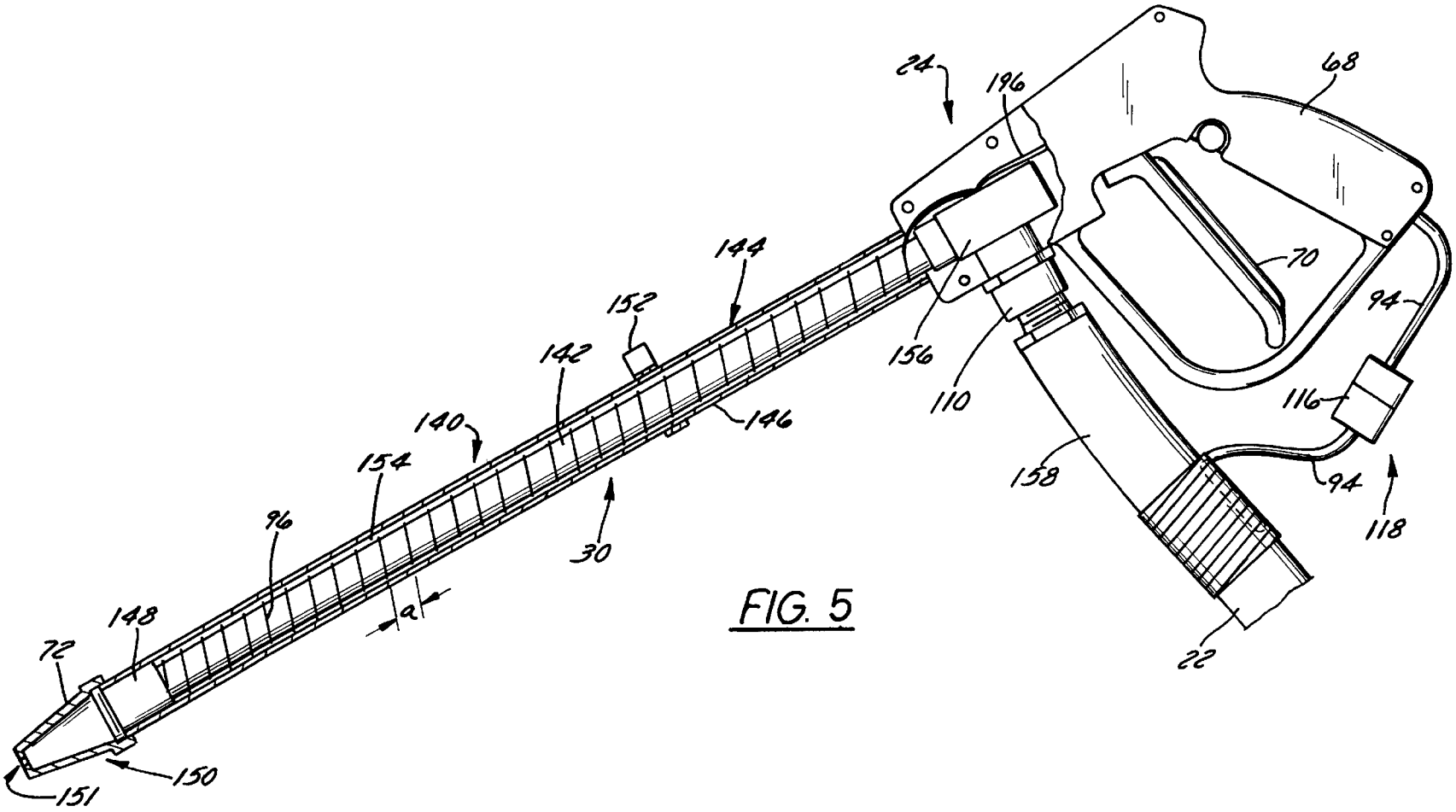
FIG. 5 is a side view of a wand of the applicator partially broken away to show its three phase heating element.

At the kettle end 106 of the hose 22, the input end 112 of the heating element cord 94 is preferably in electrical communication with a three phase electrical power source 114 (FIG. 1) for receiving three phase electrical power from the power source 114. Referring additionally to FIG. 5, at the wand end 108 of the hose 22, preferably the cord 94 is attached by a connector 116 to the heating element 30 of the wand 24. Since heating is not necessary where the cord 94 is exposed between the wand 24 and hose 22, the cord 94 preferably has a non-heating portion 118 between the wand 24 and hose 22 that preferably is constructed of a larger diameter copper wire that can be of fourteen gauge or thicker copper wire.

Alternatively, the heating element cord 94 can be constructed and arranged to terminate at or adjacent the wand end 108 of the hose 22, such as at reference numeral 120 (FIG. 4), if it is only necessary to heat the hose 22 and not the wand 24 during operation. If the heating element cord 94 terminates at the wand end 108, each of the three wires 98, 100, and 102 are connected together, preferably at reference numeral 120, to form a complete three phase heating element circuit.

To enable sensing of the temperature of the hot melt mix material within the hose 22, the hose 22 preferably also has a temperature sensor 122. As is shown in FIG. 4, the temperature sensor 122 is received in a hollow in the foam insulating layer 90 and is secured to the hose 22 by at least one layer of a tape 124 that preferably is silicone tape. Preferably, the sensor 122 is affixed to the hose 22 such that it bears against the inner hose wall 84 for being able to more accurately sense the temperature of the hose 22 and hot melt mix material in the hose 22 in the region of the sensor 122.

Preferably, the temperature sensor 122 is an RT-type thermocouple 126 for providing an electrical current representative of the temperature of the hot melt mix material inside the hose 22. To communicate current from the sensor 122 to a device, such as preferably the controller 128 (FIGS. 1, 6 and 8), the sensor 122 has a pair of wires 130 extending from it. Preferably, the sensor 122 is disposed at least about six inches from the axial end of the fixture 80 at the kettle end 106 of the hose 22 for facilitating accurate temperature measurement. Alternatively, the sensor 122 can be a thermistor or another type of sensor capable of sensing the temperature of hot melt mix inside the hose 22.

Alternatively, if desired, the temperature sensor 122 can be affixed to the wand 24 for measuring the hot melt mix material temperature at a point remote from the kettle 38. Alternatively, a pair of sensors (not shown) can be used with, for example, one of the sensors in communication with the hose 22 and the other of the sensors in communication with the wand 24. However, the preferred embodiment of this invention requires only a single sensor 122 carried by the hose 22 capable of sensing or representing the temperature of the hot melt mix material within the hose 22 and adjacent the sensor 122.

Advantageously, as a result of the construction and arrangement of the three phase heating element 30, construction of the hose 22 and the use of three phase electrical current to heat the hot melt mix, only one temperature sensor 122 is needed. Alternatively, more than one temperature sensor can be used, if desired, to provide the temperature of hot melt mix at different locations along the hose 22. Alternatively, more than one temperature sensor can be used, if desired, to provide the temperature of hot melt mix material in the wand 24 or at different locations along the wand 24.

B. Wand Construction

The wand 24 has a dispenser gun 68 with a generally cylindrical and elongate hollow barrel 140 extending outwardly from the gun 68 for enabling hot melt mix material to be dispensed from the wand 24 conveniently onto the ground without an operator 28 having to uncomfortably bend down or stoop during operation. The barrel 140 of the wand 24 is preferably constructed of a rigid, generally cylindrical and elongate pipe or tube 142 that can be constructed of a metal, such as a stainless steel; a plastic, such as a thermoset; a composite, such as a glass filled nylon; a ceramic; a combination thereof, or another suitable material. The tube 142 is hollow for permitting passage of hot melt mix material through the tube 142. The tube 142 is preferably threadably received in a complementary threaded female fitting of the dispenser gun 68.

Generally coaxially overlying the hot melt mix flow tube 142 is an outer covering 144 that preferably also is generally tubular and elongate. The outer covering 144 is spaced sufficiently radially outwardly away from the hot melt mix flow tube 142 such that it insulates a user 28 of the wand 24 from the heat of the hot melt mix flowing through the tube 142. Preferably, the covering 144 is a support tube 146 that is attached to the dispenser gun 68 at one end and a dispenser cap 148 at the other end. To help manipulate the rather long wand 24 during operation, a user 28 can grasp a handle 152 attached to the support tube 146 at a location disposed downstream from the dispenser gun 68.

The duckbill valve 72 is carried by the cap 148 at the nozzle 151 at the free end 150 of the wand 24. The cap 148 is also attached to the free end of the hot melt mix tube 142 and has an outer diameter larger than the outer diameter of the hot melt mix tube 142 for radially outwardly and coaxially spacing the support tube 146 from the hot melt mix tube 142. If desired, an envelope 154 between the hot melt mix flow tube 142 and the support tube 146 can contain an insulation, such as an open or closed cell foam.

As is shown in FIG. 5, the hot melt mix applicator wand 24 also has a heating element 30 that preferably extends to adjacent the free end 150 of the wand 24 for providing heat to hot melt mix material in the flow tube 142 of the wand 24. To complete the three phase electrical heating circuit, the wires 98, 100 and 102 of the heating element cord 94 are electrically connected together preferably in or adjacent the end cap 148.

As is shown in FIG. 5, a preferably non-heating portion 118 of the heating element cord 94 of the hose 22 emerges from a collar 158 adjacent the end 108 of the hose 22 and connects to another preferably non-heating element portion 118 of the heating element cord 94 of the wand 24. Where hot melt mix material leaving the hose 22 enters the dispenser gun 68, it is preferably redirected through a generally perpendicular elbow 156 in the gun 68 into the flow tube 142. To prevent solidification of hot melt mix material in the region of the elbow 156, at least a portion of the heating element cord 94 preferably contacts directly against the elbow 156. If desired, one or more loops of cord 94 can be wrapped around the elbow 156. If desired, the elbow 156 and heating element cord 94 can be constructed and arranged such that a portion of the cord 94 is immersed directly in the hot melt mix material.

Preferably, the construction, arrangement and spacing, a, of the three phase heating element cord 94 wrapped helically about the exterior of the hot melt mix flow tube 142 of the wand 24 is substantially the same as the heating element cord 94 wrapped about the hose 22 previously described herein and hence will not be further described.

IV. Three Phase Heating Element System, Circuit and Control

Figure 6:
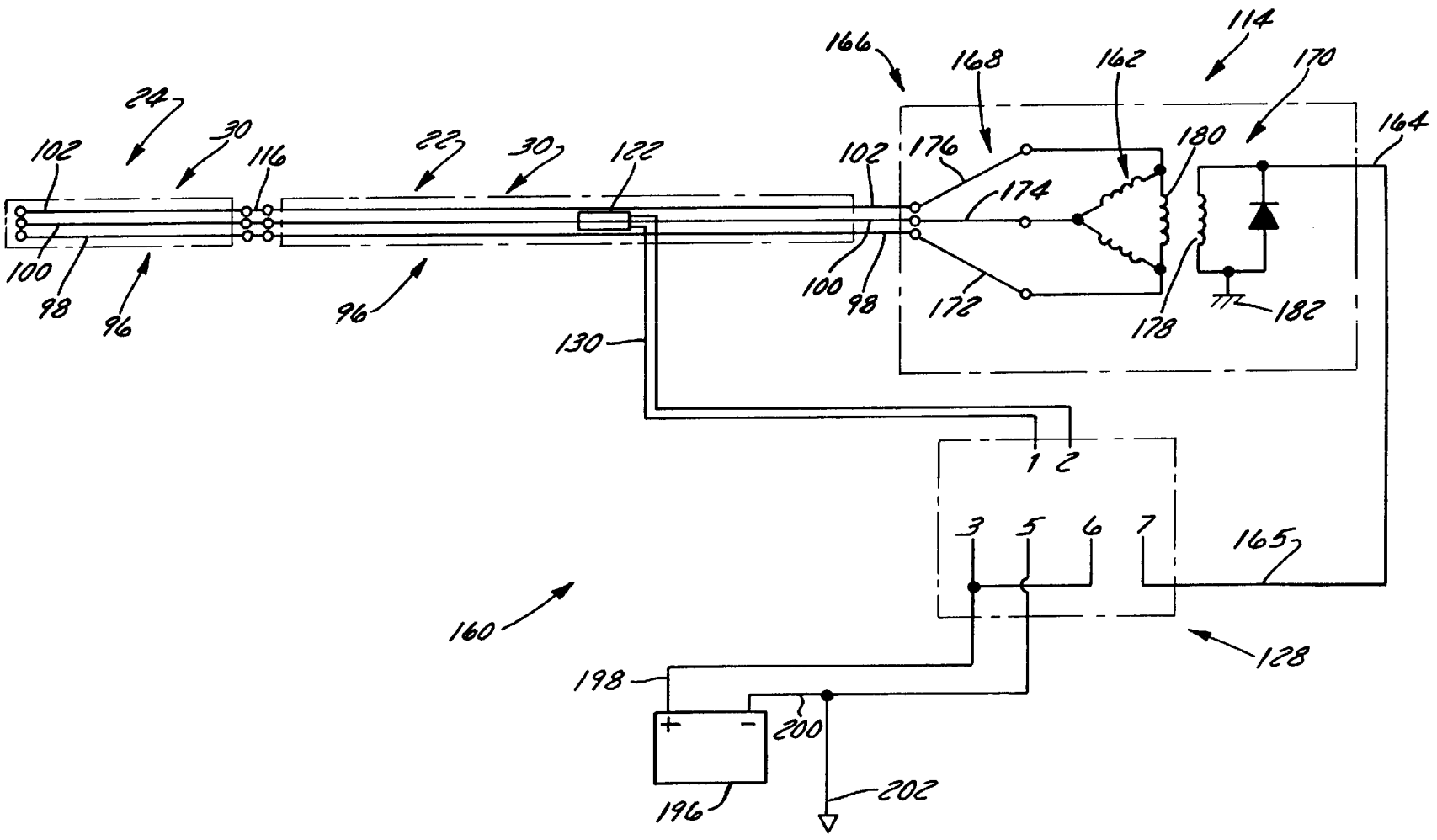
FIG. 6 is a schematic view of the heating element and control circuit for controlling the application of current to the heating element of the hose and wand.

FIG. 6 illustrates a three phase heating system 160 for controllably supplying heat preferably to both the hose 22 and wand 24 to heat and maintain hot melt mix material in both the hose 22 and wand 24 at a temperature at which the material can flow. The three phase heating system 160 is comprised of an electrical circuit 160 that includes the three phase power source 114 coupled to the three phase heating element cord 94 of the hose 22 and wand 24, with the operation of the power source 114 and heating element 30 controlled by the temperature controller 128. As is shown in FIG. 6, the heating element cord 94 of the hose 22 is connected in series to the heating element cord 94 of the wand 24.

A. Three Phase Power Source

Preferably, the three phase power source 114 is a delta three phase power source 162, as is shown in FIG. 6. Alternatively, for example. the power source 162 can be a wye three phase power source (not shown). To selectively control application of power to the heating element 30, the three phase power source 162 has a control input 164 in communication with a control output 165 of the temperature controller 128 that enables the controller 128 to selectively control operation of the heating element 30 by directly controlling operation of the power source 114.

As is shown in FIG. 6, the power source 114 preferably comprises a three phase generator 166 having a stator 168 in electrical communication with the heating element 30 and a rotor 170 connected to the control input 164. The generator control input 164 is connected to the temperature controller control output 165 for enabling the operation of the generator 166 to be directly controlled. The stator 168 is constructed and arranged in a delta configuration 162 having an output terminal 172 connected to heating element wire 98 of the heating element cord 94, another output terminal 174 connected to heating element wire 100, and a still further output terminal 176 connected to heating element wire 102.

The rotor 170 has a winding 178 in magnetic field communication with a winding 180 of the stator 168 with one leg of the winding 178 connected to a ground 182 and another leg of the winding 178 connected to the temperature controller output 165. To prevent reverse flow of current around the rotor winding 178, there is a diode 184 connected in parallel with the winding 178 to the control input 164.

In the control of the operation of the generator 166, the stator 168 is energized upon application of current from the temperature controller output 165 to the rotor input 164, thereby causing the generator 166 to generate and supply three phase electrical power to the three phase heating element 30 of the hose 22 and wand 24. When no control current is applied to the rotor 170 by the temperature controller 128, no electrical power is generated by the generator 166. Therefore, when the temperature controller 128 desires to stop the heating element 30 from supplying heat to the hose 22 and wand 24, the controller 128 simply ceases supplying control current to the rotor 170. In this manner, the amount of heat applied to the hose 22 and wand 24 can be advantageously controllably regulated in a relatively precise fashion.

When control current from the temperature controller 128 is applied to the rotor 170, the current causes the rotor winding 178 to generate a magnetic field which communicates with the stator winding 180 thereby causing electrical power to be generated. In this manner, control current energizes the stator 168 causing it to produce electrical current. When no control current is applied, no magnetic field is created, and no power is generated.

Figure 7:
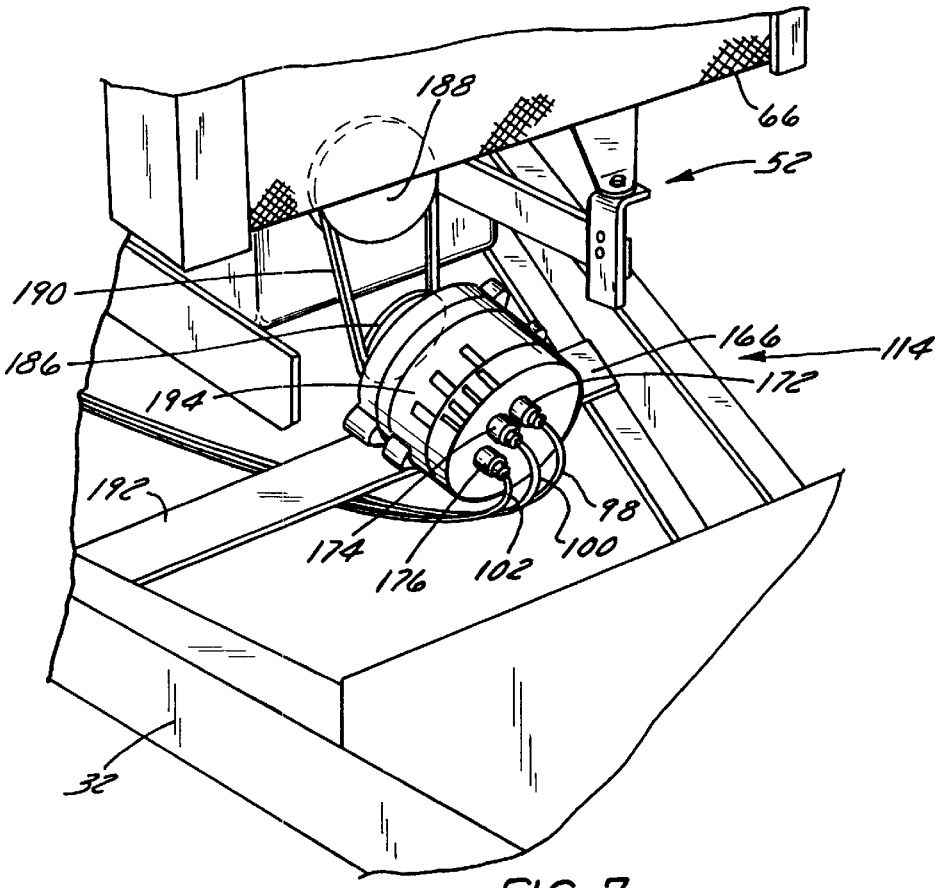
FIG. 7 is a partial fragmentary perspective view of an internal combustion engine of the applicator coupled to a generator for providing electrical power to the heating element.

Referring additionally to FIG. 7, the generator 166 has a pulley 186 on its input shaft coupled to a pulley 188 on a drive shaft of the engine 52 by an endless flexible belt 190. The generator 166 is carried by a bracket 192 affixed to the support frame 32 and has three outputs 172, 174 and 176, one for each phase of the power delivered to the heating element wires 98, 100 and 102.

Preferably, the generator 166 is a modified vehicle alternator 194 coupled to the engine 52 in the manner shown in FIG. 7. Preferably, the alternator 194 is modified so that it produces three phase current across its output terminals 172, 174 and 176. Preferably, the alternator 194 is a conventional vehicle alternator modified such that its rectifier and voltage regulator circuitry are not required, with electrical power being delivered directly from the alternator 194 to the heating element cord wires 98, 100 and 102 without needing to be regulated by any voltage or current regulator.

The alternator 194 preferably can be a modified claw-pole type alternator, although the alternator can be of compact alternator construction, can be a salient pole alternator, can be an alternator having a windingless rotor, or can be another type of generator capable of generating three phase electrical power. Preferably, the alternator 194 is a Southwest Products Model No. 333 alternator to produce three phase current. Such an alternator 194 preferably produces no greater than about sixty volts and at least about twenty volts and several amperes of electrical power during operation to cause the heating element 30 to generate a desired amount of heat to achieve and maintain the flowability of hot melt mix material within the hose 22 and wand 24. In a preferred embodiment, the alternator 194 preferably produces about thirty six volts at generally optimum operating conditions. Of course, loading on the engine by the hydraulic pump and other engine loads can cause some fluctuations in output voltage. Alternatively, the output voltage and amperage of the alternator 194 can be more or less dependent upon the construction of the alternator 194, the output speed of the engine 52, the load on the alternator 194 produced by the heating element 30, as well as other factors.

B. Temperature Controller

The temperature controller 128 is shown in block form in FIG. 6 with numbered pinouts depicting the various input and output connections of the controller 128. During operation, the temperature controller 128 communicates with the temperature sensor 122 affixed to the hose 22 and energizes or deenergizes the generator 166 in response to the hose/hot melt mix temperature sensed by the sensor 122. If the hot melt mix temperature is high enough, indicating that hot melt mix material within the hose 22 is at a temperature at which it will suitably flow, the generator 166 is not energized or is deenergized thereby causing the generator 166 to supply no electrical power to the heating element 30. Should the hot melt mix temperature drop below a predetermined value indicating that hot melt mix material within the hose 22 (1) is not at a temperature at which it will easily flow, or (2) is approaching a temperature below which it will not easily flow, the temperature controller 128 preferably energizes the generator 166 to cause electrical power to be supplied to the heating element 30 so that the hose 22 and wand 24 will be suitably heated to help ensure flowability of the hot melt mix material.

To supply power to the controller 128, the controller 128 is connected to a power source 196 that preferably is a direct current power source, such as a battery of conventional construction or the like. As is shown in FIG. 6, a positive terminal 198 of the battery is connected to pins 3 and 6 of the temperature controller 128 for supplying electrical power to the controller 128. A negative terminal 200 of the battery 196 is connected to a ground 202 that preferably can be in electrical communication with the rotor ground 182. In addition to being connected to the ground 202, the negative terminal 200 of the battery 196 is also connected to pin 5 of the temperature controller 128.

Figure 6A:
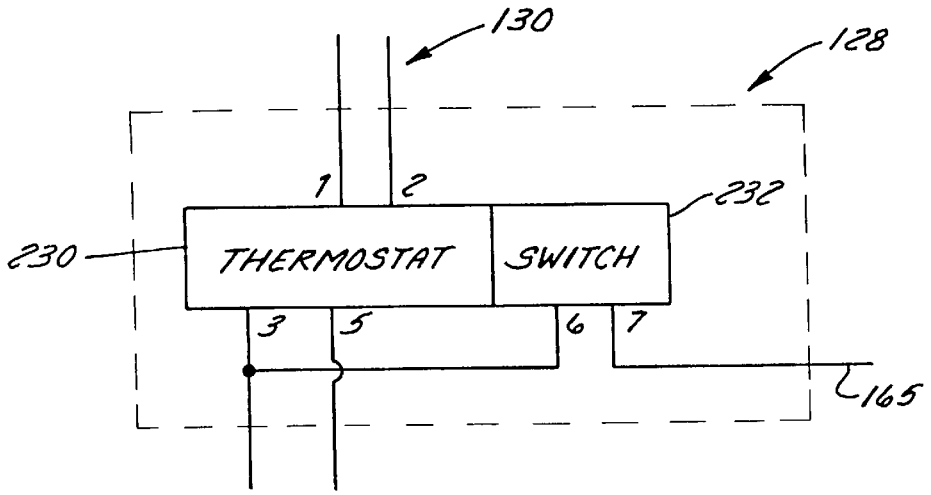

One wire 130 of the temperature sensor 122 is connected to pin 1 of the temperature controller 128 and the other wire 130 of the sensor 122 is connected to pin 2 of the controller 128 for enabling the controller 128 to communicate with the sensor 122. To control operation of the generator 166 based upon the sensed hot melt mix temperature, pin 7 of the controller 128 is the output 165 that is connected to the control input 164 of the generator 166. Preferably, pins 1 and 2 of the controller 128 extend from an integral thermostat circuit 230 (FIG. 6A) of the controller 128 which has a switching mechanism 232 (FIG. 6A), such as a conventional switch, a solid state switch, a relay or the like, for enabling a control current to be selectively delivered the rotor input 164 when the hot melt mix hose temperature is too low. Preferably, the switching mechanism 232 of the controller thermostat circuit 230 delivers control current directly or indirectly from the battery 196 to the controller output 165 which communicates the control current to the control input 164 of the generator 166.

Figure 8:
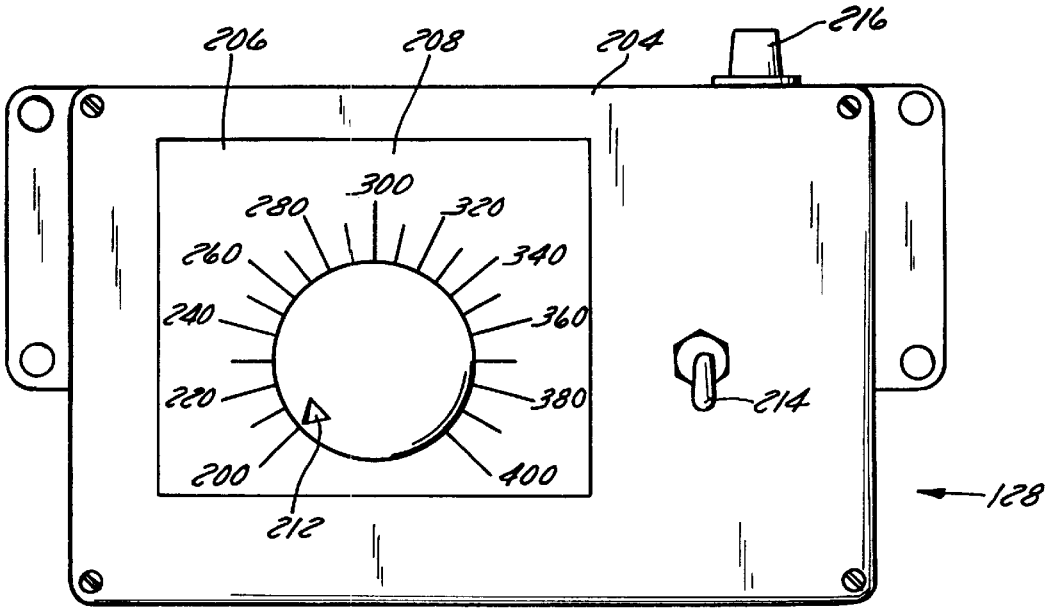
FIG. 8 is an enlarged front view of a control box for housing a temperature controller of the heating element and control circuit.

Referring additionally to FIG. 8, the temperature controller 128, including its accompanying internal circuitry, is received in a control box 204 that is affixed to the exterior of the kettle 38. If desired, the battery 196 can also be received within the control box 204. To activate the controller 128, the box 204 has an "on/off" switch 214 and an indicator light 216 on top of the box 204. Preferably, the indicator light 216 is lit when the switch 214 is switched to its "on" position.

As is shown in FIG. 8, mounted on the face of the control box 204 is an indicator label 206 indicating a plurality of control temperature settings that the controller 128 can be set at during operation. The label 206 has a plurality of control temperature settings 208 arranged in a semicircle around a control knob 210. In a preferred embodiment, as is depicted in FIG. 8, the temperature settings 208 range from 200° Fahrenheit (° F.) to 400° F. and have intermediate temperature intervals of 10° F. marked by radially outwardly emanating lines on the face of the label 206. Alternatively, depending upon the range of control temperatures desired, limitations of the controller 128, the material being heated and applied, the flow rate of the material flowing through the hose 22 and wand 24, as well as other factors, the label 206 may bear a different temperature range. Routine testing and experimentation can be done to determine an optimum temperature range for different hot melt materials, different applications, different flow rates, different operating conditions, and for other factors.

The control knob 210 has an indicator arrow 212 which indicates the desired control setting of the temperature controller 128. To communicate the control setting to the temperature controller thermostat circuitry, the knob 210 preferably is attached to a shaft of an electrical component capable of selectively variable control that preferably is a variable resistor, a potentiometer, or the like, which sets the desired control temperature for the controller 128.

Alternatively, another means for setting the control temperature can be used. For example, a digital or analog input for inputting the control temperature can be used. If a digital input is used, it can, for example, comprise a pair of push buttons coupled to a digital readout that allows the control temperature to be increased when one of the buttons is pushed and to be decreased when the other of the buttons is pushed.

In one preferred embodiment of the temperature controller 128, selection of a control temperature using the knob 210 controls when the generator 166 is energized thereby controlling heating of the hose 22, wand 24 and hot melt mix material within the hose 22 and wand 24. For example, if the knob 210 is set to a control temperature of 200° F., such as is depicted in FIG. 8, the controller 128 can be programmed to energize the generator 166 when the hot melt mix hose temperature sensed by the thermocouple 122 and controller 128 drops to either (1) the control temperature or (2) to a predetermined temperature below the control temperature.

If the controller 128 is preprogrammed to energize the generator 166 when the hot melt mix temperature is below the control temperature, it can be preprogrammed to energize when the hot melt mix temperature reaches a certain preset temperature below the control temperature. For example, the controller 128 preferably can be preprogrammed or preset such that it energizes the generator 166 when the hot melt mix temperature is five, ten, fifteen or even twenty degrees below the control temperature.

Likewise, the controller 128 can be preprogrammed to deenergize the generator 166 when the hot melt mix temperature rises to be the same as the control temperature or when it reaches a temperature above the control temperature. In a preferred embodiment, the controller 128 deenergizes the generator 166 when the sensed hot melt mix hose temperature rises to a predetermined temperature above the control temperature. For example, the controller 128 can be preprogrammed or preset such that it deenergizes the generator 166 when the hot melt mix temperature is at a temperature that is five, ten, fifteen or even twenty degrees above the control temperature.

As such, the controller 128 can be programmed to have an upper setpoint control temperature that is above the control temperature set by the user 28 and a lower setpoint control temperature that can be the same as or below the control temperature set by a user 28 for enabling the controller 128 to control generator operation such that the hose 22, wand 24 and hot melt mix material within the hose 22 and wand 24 are sufficiently heated during operation. Preferably, these upper and lower setpoint temperatures "float" around or are indexed to the control temperature set by the user 28.

Preferably, the controller 128 has a thermostat circuit 230 of conventional construction for providing an upper and lower setpoint temperature that is tied to the control temperature set by the user 28. Preferably, the controller 128 is a PAKSTAT Model No. P64A0918904, made by Paktronics Controls, Inc. of Fort Worth, Tex. and which provides these capabilities. Alternatively, the controller 128 can be another type of controller, such as for example a programmable controller capable of controlling generator operation based upon the sensed temperature of one or more of the following: the hose 22, the wand 24, the hose 22 and wand 24, the hot melt mix material within the hose 22 and/or wand 24, or a suitable combination thereof.

V. Engine Control

Figure 9:
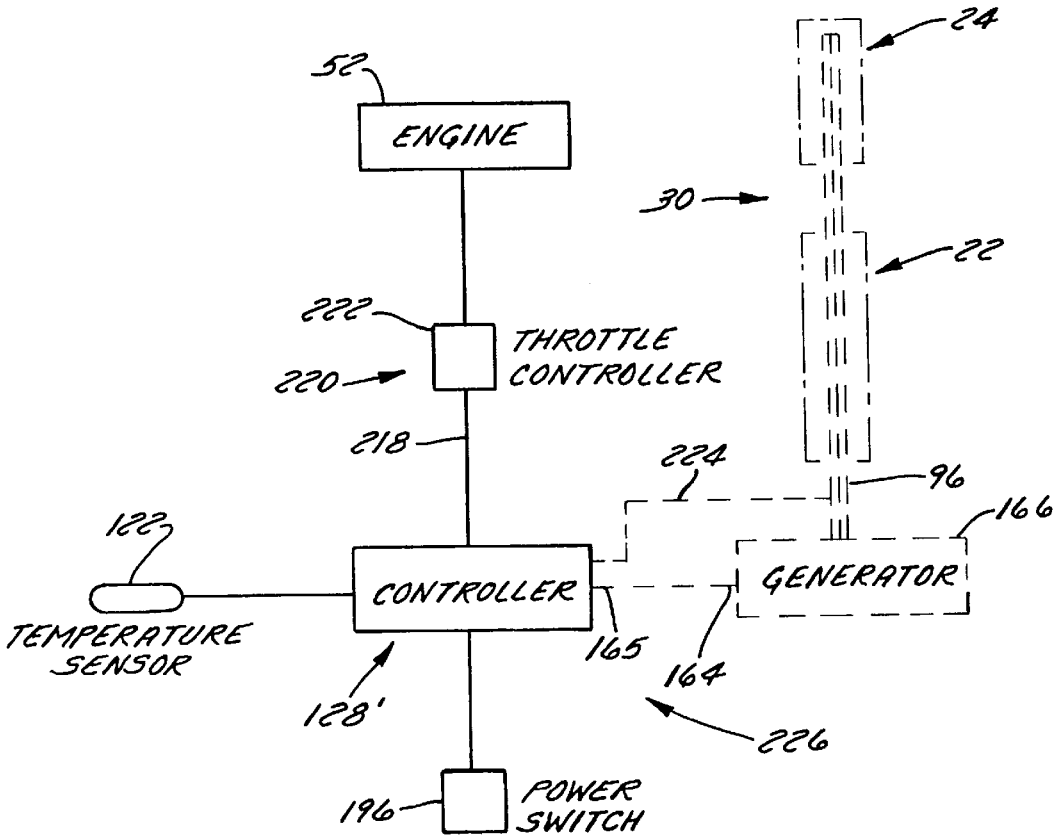
FIG. 9 is a block diagram depicting a second control system of this invention for regulating heat input to the hose and wand by regulating engine speed thereby regulating generator output.

As is depicted in FIG. 9, in another preferred embodiment of the controller 128', the controller 128' can be constructed and arranged to perform as part of an engine control system 226 to control operation of the engine 52 to help regulate the temperature of the hot melt mix material within the hose 22 and wand 24. To control operation of the engine 52, the controller 128' has a control line 218 in communication with an engine controller 220 that preferably is a throttle controller 222. Preferably, the throttle controller 222 selectively controls the speed of the engine 52 by directly controlling the position of the throttle of the engine 52 during operation. By directly controlling the speed of the engine 52 during operation, the amount of electrical power generated and supplied to the hose 22 and wand 24 can also be controlled thereby enabling heat input into the hose 22 and wand 24 to be regulated.

Preferably, the throttle controller 222 is a solenoid operably connected to the throttle of the engine 52, such as by being connected to the throttle cable of the engine 52 or the like. In response to a control signal from the controller 128 sent along control line 218, the throttle controller 222 changes position of the engine throttle by the solenoid being energized and moving the throttle. If desired, the control signal of the controller 128' can be directly applied to the solenoid itself to selectively control the position of the throttle. Alternatively, the throttle controller 222 can be integral with the controller 128'.

If desired, the speed of the engine 52 can be controlled and based upon the hot melt mix temperature sensed by the temperature sensor 122 with engine speed being increased if the sensed temperature is too low and being decreased if it is higher than necessary. For example, engine speed can be increased or decreased relative to a control temperature set and regulated in the manner discussed above.

Preferably, the speed of the engine 52 can be controlled based upon the load placed upon the generator 166 to ensure adequate electrical power is being supplied to the heating element of the hose 22 and wand 24. In one preferred embodiment, the controller 128' has a line 224 (in phantom) in electrical communication with one or more of the output terminals 172, 174, and 176 of the generator 166 or the heating element wires 98, 100 and 102 for sensing (1) voltage, (2) amperage, or (3) both voltage and amperage to ensure that the heating element 30 is generating an appropriate amount of heat for a given set of operating conditions.

If the electrical measurement sensed is too low, such as below a setpoint control voltage or current, the controller 128' speeds up the engine 52 to cause the generator 166 to output more electrical power to the heating element 30. Conversely, if the electrical measurement is too high, such as above a setpoint control voltage or current, the controller 128' reduces engine speed to cause less electrical power to be delivered to the heating element 30 thereby causing less heat to be applied to the hose 22 and wand 24.

In one preferred embodiment, the controller 128' regulates engine speed based upon the sensed output voltage of the generator 166. If, the output voltage should fall below a desired predetermined output voltage, the controller will increase engine speed thereby increasing the output voltage until it reaches or suitably exceeds the desired voltage. Conversely, if the output voltage is too great, the engine 52 is slowed preferably until the output voltage approaches or falls within an acceptable range of the desired preset voltage. In one preferred embodiment, the output voltage of the generator 166 is, for example, about thirty six volts for ensuring a heating element heating flux of about of about 3.5 watts per inch$^2$.

Additionally, the controller 128' can also function as temperature controller 128 by also controlling the operation of the generator 166 in the manner previously discussed. In combination, in response to the hot melt mix temperature and electrical output of the generator 166, the engine speed and generator operation can be suitably controlled to control heating of the hose 22 and wand 24 in a carefully controlled manner over a wide range of operating conditions and the like.

VI. Use and Operation

A. Use

In use, the three phase hose and wand heating system 160 of this invention, including the three phase generator 166, three phase heating element 30 and controller 128, is well suited for controlling the heating of the hose 22 and wand 24 of a hot melt mix applicator 20 that can dispense hot melt materials such as bitumen, tar, asphalt, asphalt mixtures, petroleum based mixtures, petroleum based sealants, thermoplastic sealants, thermoplastic paints, thermoplastic plastics, other thermoplastic materials and other materials which can be made flowable upon the application of heat. Preferably, the heating system 160 is particularly well suited for use in conventional hot melt mix applicators, asphalt dispensers, pavement crack sealing machines, and other types of thermoplastic material dispensers and applicators that use a hose 22, a wand 24, or both a hose 22 and wand 24 to effect dispensing of the thermoplastic material. Although well suited for use to heated mixtures of two or more materials, the wand and hose heating system 160 of this invention is also well suited for heating hot melt materials that are not mixtures. The engine speed control system 226 of this invention is also particularly well suited for these applications.

B. Operation

In preparation for startup, the switch 214 of the temperature controller 128 is turned to its "on" position and the control knob 210 is set at a desired control temperature for the particular material being applied by the hot melt mix applicator 20. Upon startup of the applicator 20, hot melt mix material inside the kettle 38, inside the hose 22 and inside the wand 24 is heated to or preferably above a temperature at which the hot melt mix material will flow.

To do this, the engine 52 is started, enabling three phase electrical power to be generated by the three phase generator 166. To determine whether the generator 166 will be energized, the temperature controller 128 communicates with the temperature sensor 122 to determine the temperature of the hose 22 and hot melt mix within the hose 22 that is adjacent the sensor 122. If the temperature is below the control temperature or below its lower setpoint temperature, the generator 166 is energized by the controller 128 causing current flow in each of the three phase heating element wires 98, 100 and 102 which heats the hose 22 and wand 24.

As the hot melt mix material within the hose 22 and wand 24 is heated, the hot melt mix material begins to melt making it flowable. After a sufficient heating interval of time has elapsed, the hot melt mix within both the hose 22 and wand 24 will be sufficiently hot such that it will flow. Preferably, when the hot melt mix material within the hose 22 and wand 24 has reached a flowable state and the temperature controller 128 senses that the hot melt mix temperature has reached the upper setpoint temperature, the controller 128 deenergizes the generator 166 thereby ceasing current flow to the heating element 30.

If desired, the controller 128 can provide a signal to the operator 28, in the form of an indicator light or otherwise (not shown), that the hot melt mix material within the hose 22 and wand 24 have reached the desired temperature and is in a flowable state. If desired, to expedite heating of the hot mix material during startup until it reaches a flowable state, the controller 128 can communicate with the engine 52 to cause the engine 52 to run at least slightly faster than normal.

In operation, as hot melt mix material is pumped from the kettle 38, it flows through the hose 22 and is dispensed from the duckbill valve 72 at the end of the wand 24 onto a surface that preferably is pavement, roadway or the like. Should the temperature of the hot melt mix material within the hose 22 drop below the lower control temperature or lower setpoint temperature, the controller 128 activates the generator 166 thereby supplying current to each of the wires 98, 100 and 102 of the heating element 30 causing hot melt mix material within the hose 22 and wand 24 to be heated. When the temperature of the sensor 122 reaches the upper setpoint temperature, the controller 128 deenergizes the generator 166 ceasing current flow to the heating element 30.

The control system 160 is particularly well suited for keeping the hot melt mix material within the hose 22 and wand 24 in a flowable state during periods of inactivity, such as when the applicator 20 is operating but no hot melt mix is being dispensed. When the applicator 20 is operating and no hot melt mix is being dispensed, hot melt mix is not flowing through the hose 22 and wand 24 and can therefore cool within the hose 22 and wand 24 causing some solidification. During these periods, the three phase heating system 160 advantageously maintains the hot melt mix material at a temperature at which it will readily flow despite the cooling that ordinarily takes place.

Although the aforementioned heating system 160 is designed to controllably heat both the hose 22 and wand 24, it is within the contemplated scope of the invention to modify the system 160 to controllably heat only the hose 22, only the wand 24, or both the hose 22 and wand 24 independently of each other. If heated independently of each other, the hose 22 preferably has its own heating element and temperature sensor and the wand 24 preferably has its own heating element and sensor, with current flow controlled such that it can be delivered to one of the heating elements independently of the other heating elements.

It is also to be understood that, although the foregoing description and drawings describe and illustrate in detail one or more embodiments of the present invention, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims and the applicable prior art.

What is claimed is:

1. An applicator for applying a solid material that becomes flowable when heated comprising:

a frame;

a source of the solid material that becomes flowable when heated, the source carried by the frame;

a heater, in thermal relation with the source, for heating the solid material that becomes flowable when heated so it becomes flowable;

a movable, elongate conduit disposed exteriorly of the source and which has a pair of spaced apart openings with one of the openings in fluid flow communication with the source;

a pump carried by the frame that urges the solid material within the source that has become flowable when heated from the source through the conduit where the solid material that has become flowable when heated is urged by the pump through another of the openings in the conduit;

a source of three phase electric current;

an electric three phase heating element that is 1) supplied with three phase electric current from the three phase electric current source, and 2) disposed in thermal conductive relationship with the conduit for heating the solid material that becomes flowable when heated that is disposed in the conduit;

wherein the conduit is manipulated by an operator during operation of the applicator to direct a flow of the solid material that has become flowable when heated that is being discharged from the conduit; and wherein the source of three phase electric current has a voltage that is no greater than about 60 volts.

2. An applicator as defined in 1 claim wherein the voltage is greater than about 20 volts.

3. An applicator as defined in claim 1 wherein the conduit comprises a sidewall, a layer of insulation disposed exteriorly of the sidewall, a covering disposed exteriorly of the layer of insulation, and wherein the three phase heating element is disposed in thermal relation with the sidewall between the sidewall and the layer of insulation.

4. An applicator as defined in claim 1 wherein the three phase heating element comprises a resistive three phase heating element.

5. An applicator as defined in claim 1 further comprising:

an internal combustion engine carried by the frame;

a plurality of wheels carried by the frame that space 1) the frame, 2) the source of the solid material that becomes flowable when heated, 3) the heater, and 4) the pump above a surface that is located below the applicator;

wherein the source of the solid material that becomes flowable when heated comprises a tank having an agitator therein for agitating the solid material within the tank that has been heated such that it is flowable;

wherein the source of three phase electric current comprises a three phase generator operably coupled to the internal combustion engine; and wherein the wheels permit the applicator to be moved.

6. An applicator as defined in claim 1 further comprising:

an internal combustion engine that is carried by the frame;

a plurality of wheels carried by the frame that space 1) the frame, 2) the source of the solid material that becomes flowable when heated, 3) the heater, and 4) the pump above a surface that is disposed below the applicator;

wherein the source of the solid material that becomes flowable when heated comprises a tank having an agitator therein;

wherein the source of three phase electric current comprises a three phase generator operably coupled to the internal combustion engine that provides three phase electric current at a voltage of at least about 20 volts when supplying three phase electrical power to the three phase electric heating element;

wherein the conduit is flexible and comprises a sidewall, a layer of insulation disposed exteriorly around the sidewall, a covering disposed exteriorly around the layer of insulation, and wherein the three phase heating element is disposed in thermal relation with the sidewall between the sidewall and the layer of insulation.

7. An applicator as defined according to claim 1 wherein 1) the conduit comprises a flexible hose having a free end and a dispenser attached to the free end of the hose, 2) the dispenser includes a valve that enables the operator to selectively dispense solid material that has become flowable when heated, and 3) the three phase heating element is disposed in thermal relation with both the flexible hose and the dispenser.

8. An applicator as defined in claim 7 wherein the dispenser comprises a gun-type dispenser having an elongate tubular wand with an opening at one end and a trigger-type valve that enables the solid material that has been heated such that it has become flowable to be selectively discharged therefrom.

9. An applicator as defined according to claim 1 wherein the solid material that becomes flowable when heated comprises a hot melt mix material that is heated to a temperature in excess of 300° Fahrenheit to transition the state of the solid material that becomes flowable when heated from being completely solid to being flowable.

10. An applicator as defined according to claims 1 wherein the solid material that becomes flowable when heated comprises one of the following: a bitumen, a tar, an asphalt, an asphalt mixture, a sealant, or a thermoplastic paint.

11. An applicator as defined in claim 1 wherein the conduit comprises a tubular sidewall, a layer of insulation disposed exteriorly around the sidewall, a covering disposed exteriorly around the layer of insulation, and wherein the three phase heating element is disposed between the sidewall and the layer of insulation and extends substantially the longitudinal length of the conduit.

12. An applicator as defined in claim 1 wherein the three phase heating element comprises a plurality of pairs of wires constructed and arranged to form a cord that is helically wrapped around the conduit in spaced apart loops such that a plurality of pairs of adjacent pairs of the loops are spaced apart between about one-half inch and about one inch such that the three phase heating element provides a heating flux of at least about 2.5 watts per square inch of the conduit.

13. An applicator as defined in claim 1 wherein the three phase heating element comprises a plurality of pairs of wires constructed and arranged to form a cord that is helically wrapped around the conduit in spaced apart loops of the cord such that a plurality of pairs of adjacent pairs of the loops are spaced apart between about one-half inch and about one inch such that the three phase heating element provides a heating flux of at least about 3.5 watts per square inch of the conduit when the three phase heating element is supplied with three phase electric current having a voltage of between about 20 volts and about 60 volts so as to heat the solid material that becomes flowable when heated that is disposed within the conduit to at least one of 1) a temperature at or above which the solid material that becomes flowable when heated becomes flowable, and 2) a temperature that maintains the solid material that has been heated and become flowable in a flowable state.

14. An applicator as defined in claim 1 wherein the three phase heating element is comprised of three elongate heating element wires that each provide heat along at least some portion of their length when supplied with three phase electric current.

15. An applicator as defined in claim 14 wherein the three heating element wires are captured by electrical insulation to form a cord that has an oblong cross-section and which is wrapped in a spiral about the conduit.

16. An applicator as defined in claim 1 wherein the source comprises a double-walled boiler having an oil disposed between a pair of spaced apart walls of the double walled boiler, the pump comprises a gear-rotor pump, and the heater heats the oil such that the solid material that becomes flowable when heated is heated to a temperature of at least about 350° Fahrenheit.

17. An applicator as defined in claim 1 wherein 1) the source of three phase electric current has three outputs with a first one of the outputs for outputting one phase of the three phase electric current, a second one of the outputs for outputting a second phase of the three phase electric current, and a third one of the outputs for outputting a third phase of the three phase electric current, 2) the three phase electric heating element is comprised of three wires with a first one of the wires electrically coupled to the one of the outputs, a second one of the wires electrically coupled to the second one of the outputs, and a third one of the wires electrically coupled to the third one of the outputs, and 3) each of the wires of the three phase heating element provides heat along some portion of its length when the three phase electric heating element is supplied with three phase electric current.

18. An applicator as defined in claim 1 further comprising a dispenser in fluid flow communication with the another of the openings in the conduit.

19. An applicator as defined in claim 18 wherein the dispenser comprises a valve and a nozzle through which the solid material that becomes flowable when heated is discharged.

20. An applicator as defined in claim 1 wherein the source of three phase electrical current comprises a three phase alternating current generator that is directly coupled to the electric three phase heating element without any voltage regulation and without any current regulation.

21. An applicator as defined in claim 20 wherein the alternator comprises an automotive vehicle alternator that lacks a voltage regulator and that lacks a current regulator.

22. An applicator for dispensing a solid material that becomes flowable when heated comprising:

a frame having a pair of spaced apart wheels that enable the applicator to be moved;

a tank carried by the frame for holding the solid material that becomes flowable when heated;

a heater in thermal relation with the tank that heats the solid material that becomes flowable when heated to a temperature of at least about 350° Fahrenheit such that it becomes flowable;

a movable, flexible hose disposed exteriorly of the tank with the hose having a tubular sidewall and a pair of spaced apart openings with one of the openings operably connected to the tank and the other of the openings operably connected to a dispenser;

a pump in operable cooperation with the tank that urges the solid material within the tank that has become flowable when heated from the tank through the hose where the solid material that has become flowable when heated can be discharged from the dispenser;

a prime mover carried by the frame;

a source of three phase electric current that provides a voltage of at least about 20 volts;

an elongate three phase electric heating element cord that is 1) supplied with three phase electric current from the three phase electric current source, 2) wrapped around the sidewall of the hose substantially the length of the hose for heating the solid material that becomes flowable when heated that is disposed in the hose, and 3) constructed and arranged to provide a heat flux of at least about 2.5 watts per square inch of the sidewall of the hose along the length of the hose where the three phase electric heating element cord has been wrapped when three phase electric current is supplied to the three phase electric heating element cord;

wherein the hose and dispenser are manipulated by an operator during operation of the applicator to selectively direct from the dispenser a flow of the solid material that has been heated such that it is flowable; and wherein the solid material that becomes flowable when heated comprises one of a bitumen, a tar, an asphalt, an asphalt mixture, a sealant, and a thermoplastic paint.

23. An applicator as defined in claim 22 wherein the dispenser has an elongate tubular barrel and the three phase heating element is wrapped around the barrel substantially the length of the barrel.

24. An applicator as defined in claim 23 wherein the three phase heating element is wrapped helically around the sidewall of the hose and the barrel.

25. An applicator for dispensing a solid material that becomes flowable when heated comprising:

a frame spaced above a surface disposed below the frame by a pair of spaced apart wheels that support the frame on the surface and enable the applicator to be moved;

a tank carried by the frame that holds the solid material that becomes flowable when heated, the tank having an agitator therein that agitates the solid material that has been heated and become flowable;

an on-board heater in thermal relation with the tank for heating the solid material that becomes flowable when heated that is disposed in the tank to a temperature in excess of 300° Fahrenheit;

an elongate conduit that 1) is movable relative to the frame, 2) is comprised of a tubular sidewall, 3) has a pair of spaced apart openings with one of the openings in fluid flow communication with the tank and the other of the openings in fluid flow communication with a dispenser, and 4) is manipulated by an operator during operation of the applicator to direct a flow of the solid material that has been heated and become flowable that is being discharged from the dispenser;

an on-board pump that is in fluid flow communication with the tank for urging the solid material that has become flowable when heated from the tank through the conduit where the solid material that has become flowable is discharged from the dispenser;

an internal combustion engine carried by the frame;

an on-board fuel tank that supplies fuel to the internal combustion engine;

a three phase electric generator operably coupled to the internal combustion engine for generating a three phase electric current having a voltage that is at least about 20 volts and no greater than about 60 volts for reducing the risk of injury to the operator from electrical shock;

an electric three phase heating element that is supplied with three phase electric current from the three phase electric generator and that is comprised of a plurality of pairs of wires arranged in a cord that is arranged in a plurality of pairs of spaced apart loops wrapped around the sidewall of the conduit with a plurality of pairs of adjacent pairs of the loops being spaced apart between about one-half inch and about one inch such that the three phase heating element provides a heating flux of at least about 3.5 watts per square inch of the sidewall of the conduit where the heating element contacts the sidewall of the conduit when the three phase heating element is supplied with the three phase electric current.

26. An applicator for dispensing a solid material that becomes flowable when heated comprising:

a frame spaced from a surface disposed below the frame by a pair of spaced apart wheels that enable the applicator to be moved;

a tank carried by the frame that holds the solid material that becomes flowable when heated, the tank having an agitator therein that agitates the solid material that has become flowable when heated, a heater for heating the solid material that becomes flowable when heated that is disposed in the tank, and a pump disposed in the tank;

a flexible, elongate hose that 1) is movable relative to the frame, 2) is comprised of a tubular sidewall, 3) has a pair of spaced apart openings with one of the openings in fluid flow communication with the tank and the other of the openings in fluid flow communication with a dispenser, and 4) is manipulated by an operator during operation of the applicator;

an internal combustion engine carried by the frame;

a three phase electric generator operably coupled to the internal combustion engine for generating a three phase electric current having a voltage that is at least about 20 volts and no greater than about 60 volts;

an electric three phase heating element that is supplied with three phase electric current from the three phase electric generator and that is comprised of a plurality of pairs of wires in contact with the sidewall of the conduit substantially the length of the conduit such that the three phase heating element provides a heating flux of at least about 3.5 watts per square inch of the sidewall of the hose where the heating element is disposed in contact with the sidewall of the hose when the three phase heating element is supplied with the three phase electric current; and wherein the pump urges the solid material that has been heated and become flowable from the tank through the hose where it is discharged from the dispenser.

27. An applicator for dispensing a solid material that becomes flowable when heated comprising:

a frame spaced from a surface disposed below the frame by a pair of wheels that enable the applicator to be moved;

a tank carried by the frame that holds the solid material that becomes flowable when heated, the tank having 1) a heater for heating the solid material disposed in the tank so it becomes flowable, 2) an agitator that agitates the solid material in the tank that has become flowable when heated, and 3) a pump disposed inside the tank;

an elongate and flexible hose that 1) is movable relative to the frame, 2) is disposed outside the tank, 3) is comprised of a tubular sidewall covered by a layer of an insulation, 4) has a pair of spaced apart openings with one of the openings in fluid flow communication with the tank and the other of the openings in fluid flow communication with a dispenser, and 5) is movable by an operator during operation of the applicator;

an internal combustion engine carried by the frame;

a three phase electric generator operably coupled to the internal combustion engine for generating three phase electric current having a voltage that is at least about 20 volts and that is no greater than about 60 volts, the three phase electric generator comprising a stator having three output terminals and a rotor having a control input;

an electric three phase heating element that is supplied with three phase electric current from the three phase electric generator and that is comprised of a plurality of pairs of heating element wires having one of the heating element wires electrically coupled to one of the output terminals of the three phase generator, another one of the heating element wires electrically coupled to another one of the output terminals of the three phase generator, and a still another one of the heating element wires electrically coupled to a still another one of the output terminals of the three phase generator, wherein the three phase heating element is disposed in thermal relation with the sidewall of the hose between the sidewall of the hose and the layer of insulation;

a temperature sensor in thermal relation with the hose for providing a temperature signal representative of a temperature of the solid material that becomes flowable when heated that is disposed in the hose;

a temperature controller that is electrically coupled to the temperature sensor and which selectively applies a control signal to the control input of the rotor of the three phase electric generator that energizes the three phase electric generator such that the three phase electric generator supplies three phase electric current to the three phase heating element in response to the temperature signal received by the temperature controller from the temperature sensor; and wherein the solid material that becomes flowable when heated comprises one of a bitumen, a tar, an asphalt, an asphalt mixture, a sealant, and a thermoplastic paint.

28. An applicator for delivering a solid material that becomes flowable when heated comprising:

a frame;

a tank carried by the frame for holding the solid material that becomes flowable when heated, the tank having a pair of spaced apart agitators therein for mixing the solid material in the tank that has been heated and become flowable;

a heater in thermal relation with the tank that heats the solid material that becomes flowable when heated to a temperature such that the solid material becomes flowable;

a movable, flexible hose disposed exteriorly of the tank with the hose having a tubular sidewall and a pair of spaced apart ends with one of the ends operably connected to the tank and the other of the ends operably connected to a dispenser;

a pump disposed in the tank between the pair of the agitators for urging solid material in the tank that has been heated and become flowable from the tank through the hose where the solid material that has become flowable when heated can be selectively dispensed from the dispenser;

an internal combustion engine carried by the frame;

a three phase electric current generator operably coupled to the internal combustion engine, the three phase electric current generator providing three phase electric current having a voltage of between about 20 volts and no greater than about 60 volts;

an elongate three phase electric heating element cord that is 1) supplied with three phase electric current from the three phase electric current generator, 2) wrapped around a portion of the sidewall of the hose, and 3) constructed and arranged to provide a heat flux of at least about 2.5 watts per square inch of the sidewall of the hose along the length of the hose where the three phase electric heating element cord has been wrapped when three phase electric current is supplied to the three phase electric heating element cord;

wherein the hose and dispenser are manipulated by an operator during operation of the applicator to selectively direct from the dispenser a flow of the solid material that has been heated such that it is flowable; and wherein the solid material that becomes flowable when heated comprises one of a bitumen, a tar, an asphalt, an asphalt mixture, a sealant, and a thermoplastic paint.

29. An applicator for dispensing a solid material that becomes flowable when heated comprising:

a frame having a pair of spaced apart wheels that enable the applicator to be moved;

a tank carried by the frame for holding the solid material that becomes flowable when heated, the tank having an agitator in the tank for mixing the solid material in the tank that has been heated and become flowable;

a heater in thermal relation with the tank that heats the solid material that becomes flowable when heated to a temperature such that the solid material becomes flowable;

a movable, flexible hose disposed exteriorly of the tank with the hose having a tubular sidewall and a pair of spaced apart ends with one of the ends operably connected to the tank and the other of the ends operably connected to a dispenser;

a pump disposed inside the tank for urging solid material in the tank that has become flowable when heated from the tank through the hose where the solid material that has become flowable when heated can be selectively dispensed from the dispenser;

an internal combustion engine carried by the frame;

a vehicle alternator lacking 1) a voltage regulator and 2) a current regulator on-board the vehicle alternator, the vehicle alternator operably coupled to the internal combustion engine and providing three phase electric current having a voltage of between about 20 volts and no greater than about 60 volts;

an elongate three phase electric heating element cord that is 1) supplied with three phase electric current from the vehicle alternator, 2) wrapped around a portion of the sidewall of the hose, and 3) constructed and arranged to provide a heat flux of at least about 2.5 watts per square inch of the sidewall of the hose along the length of the hose where the three phase electric heating element cord has been wrapped when three phase electric current is supplied to the three phase electric heating element cord; and wherein the hose and dispenser are manipulated by an operator during operation of the applicator to selectively direct from the dispenser a flow of the solid material that has been heated such that it is flowable.

30. A heated hose for an applicator that dispenses a solid material that becomes flowable when heated comprising:

a tubular sidewall;

a plurality of pairs of wires that form a three phase electric heating element that are wrapped around the tubular sidewall substantially the length of the hose;

a layer of insulation disposed over the three phase electric heating element; and wherein three phase electric current having a voltage of between about 20 volts and about 60 volts is supplied to the three phase electric heating element such that the three phase electric heating element produces a heat flux of at least about 2.5 watts per square inch of the hose along where the three phase electric heating element is wrapped to heat the solid material that is flowable when heated at least to a temperature at which the solid material becomes flowable; and wherein the solid material that becomes flowable when heated comprises one of a bitumen, a tar, an asphalt, or an asphalt mixture.

31. An applicator as defined in claim 22 wherein the three phase electric current source comprises a three phase alternating current generator operably coupled to the prime mover, wherein the three phase alternating current generator lacks a voltage regulator and lacks a current regulator.

32. An applicator as defined in claim 31 wherein the three phase alternating current generator comprises an automotive vehicle alternator.

33. An applicator as defined in claim 25 wherein the three phase electric generator is directly connected to the electric three phase heating element without its output being regulated by a regulator.

34. An applicator as defined in claim 33 wherein the three phase electric generator comprises an automotive vehicle alternator that lacks a voltage regulator and that lacks a current regulator.

* * * * *